US010843232B2

(12) United States Patent
Hawkins

(10) Patent No.: US 10,843,232 B2
(45) Date of Patent: Nov. 24, 2020

(54) ROTARY CLEANING TOOL ASSEMBLY

(71) Applicant: Robert C. Hawkins, East Orange, NJ (US)

(72) Inventor: Robert C. Hawkins, East Orange, NJ (US)

( * ) Notice: Subject to any disclaimer, the term of this patent is extended or adjusted under 35 U.S.C. 154(b) by 186 days.

(21) Appl. No.: 15/983,264

(22) Filed: May 18, 2018

(65) Prior Publication Data

US 2019/0351458 A1 Nov. 21, 2019

(51) Int. Cl.

| | |
|---|---|
| ***F28G 3/00*** | (2006.01) |
| ***B08B 1/00*** | (2006.01) |
| ***A46B 7/04*** | (2006.01) |
| ***A46B 13/00*** | (2006.01) |
| ***A46B 13/02*** | (2006.01) |

(52) U.S. Cl.

CPC ..... *B08B 1/002* (2013.01); *A46B 7/044* (2013.01); *A46B 13/001* (2013.01); *A46B 13/02* (2013.01)

(58) Field of Classification Search

USPC ..... 15/104.95, 22.1, 23, 104.5, 88

See application file for complete search history.

(56) References Cited

U.S. PATENT DOCUMENTS

| | | | | |
|---|---|---|---|---|
| 3,661,018 | A * | 5/1972 | Keefer | A46B 13/023 74/22 R |
| D334,287 | S | 3/1993 | Ingles | |
| 5,488,747 | A | 2/1996 | Woodhouse | |
| 5,636,400 | A | 6/1997 | Young | |
| 5,781,955 | A * | 7/1998 | Hendricks | A46B 13/02 15/22.1 |
| 5,809,601 | A * | 9/1998 | Rivera | A46B 13/02 15/104.05 |
| 6,170,107 | B1 * | 1/2001 | George | A46B 5/02 15/23 |
| 6,295,681 | B1 | 10/2001 | Dolah | |
| 7,260,862 | B1 * | 8/2007 | DeFilippis | A46B 5/0095 15/22.1 |
| 7,356,867 | B1 * | 4/2008 | Beiermann | A46B 13/001 15/104.04 |
| 2004/0074025 | A1 * | 4/2004 | Blaustein | B25F 3/00 15/23 |

* cited by examiner

*Primary Examiner* — Joseph J Hail
*Assistant Examiner* — Shantese L McDonald

(57) ABSTRACT

A rotary cleaning tool assembly for cleaning difficult to clean articles includes a housing that defines an interior space. A power module and a motor are coupled to the housing and are positioned in the interior space. The motor is operationally coupled to the power module. Each of a plurality of cleaning heads is selectively couplable to the housing so that the cleaning head is operationally coupled to the motor. The motor is positioned to rotate the cleaning head to clean an article.

17 Claims, 6 Drawing Sheets

ROTARY CLEANING TOOL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to tool assemblies and more particularly pertains to a new tool assembly for cleaning difficult to clean articles.

BRIEF SUMMARY OF THE INVENTION

An embodiment of the disclosure meets the needs presented above by generally comprising a housing that defines an interior space. A power module and a motor are coupled to the housing and are positioned in the interior space. The motor is operationally coupled to the power module. Each of a plurality of cleaning heads is selectively couplable to the housing so that the cleaning head is operationally coupled to the motor. The motor is positioned to rotate the cleaning head to clean an article.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
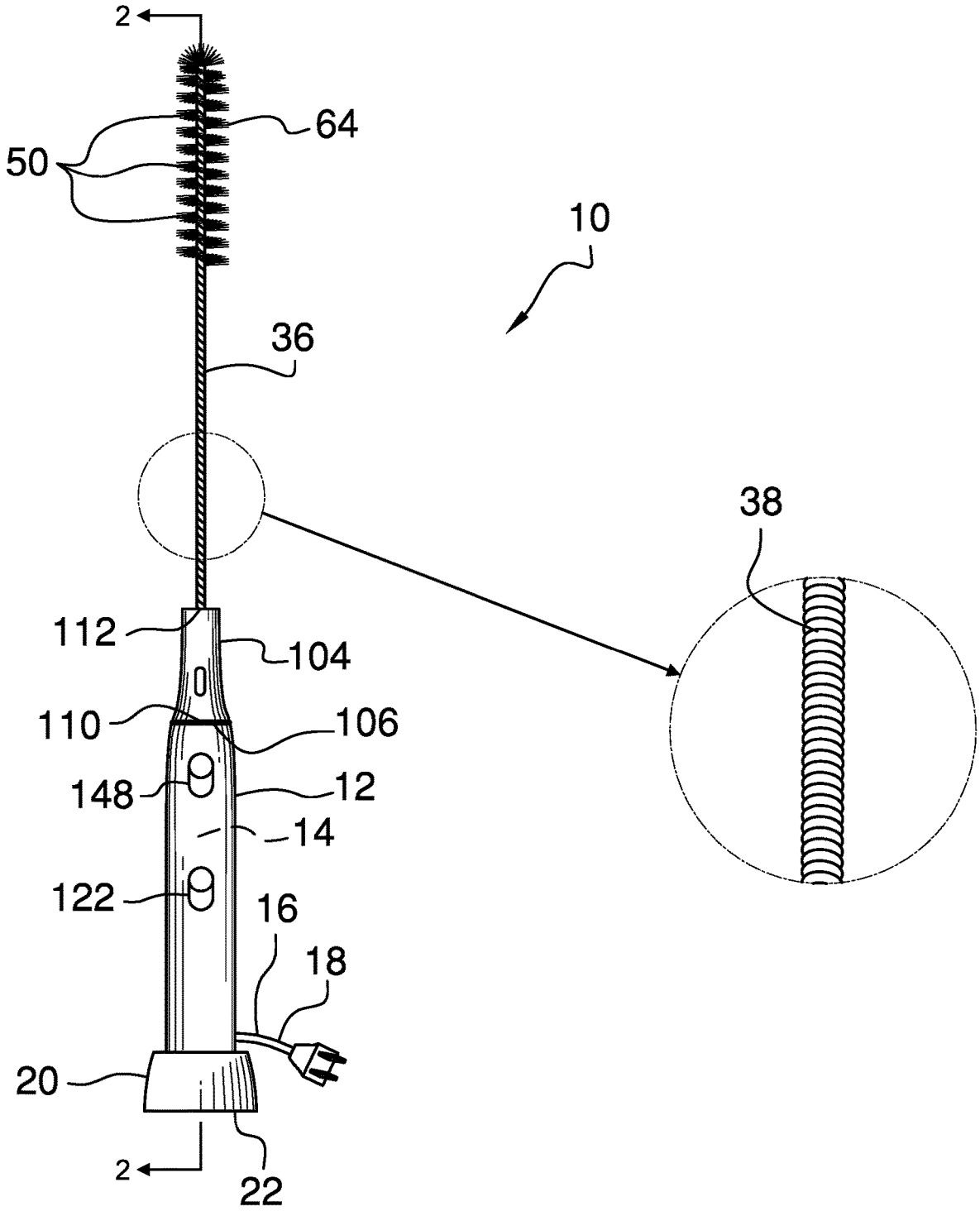
FIG. 1 is a side view of a rotary cleaning tool assembly according to an embodiment of the disclosure.

With reference now to the drawings, and in particular to FIGS. 1 through 13 thereof, a new tool assembly embodying the principles and concepts of an embodiment of the disclosure and generally designated by the reference numeral 10 will be described.

As best illustrated in FIGS. 1 through 13, the rotary cleaning tool assembly 10 generally comprises a housing 12 that defines an interior space 14. The housing 12 is substantially cylindrically shaped, as shown in FIG. 3. A power module 16 is coupled to the housing 12 and is positioned in the interior space 14. The power module 16 comprises a power cord 18, as shown in FIG. 1.

The assembly 10 comprises a base unit 20, as shown in FIG. 1. The base unit 20 has a lower face 22 that is configured to rest on a horizontal surface. A recess 24 is positioned in an upper face 26 of the base unit 20. The recess 24 is complementary to a first end 28 of the housing 12. The recess 24 is positioned to insert the first end 28 of the housing 12 to support the housing 12 substantially perpendicularly to the horizontal surface.

A motor 30 is coupled to the housing 12 and is positioned in the interior space 14. The motor 30 is operationally coupled to the power module 16. Each of a plurality of cleaning heads 32 is selectively couplable to the housing 12 so that the cleaning head 32 is operationally coupled to the motor 30. The motor 30 is positioned to rotate the cleaning head 32 to clean an article.

Figure 4:
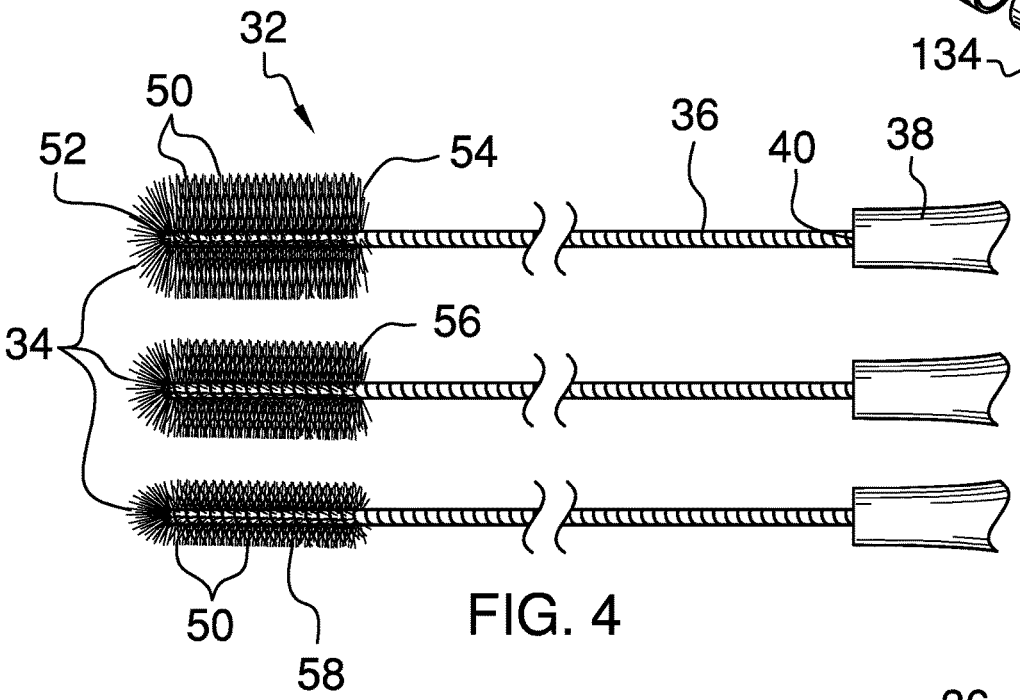
FIG. 4 is a side view of an embodiment of the disclosure.
Figure 5:
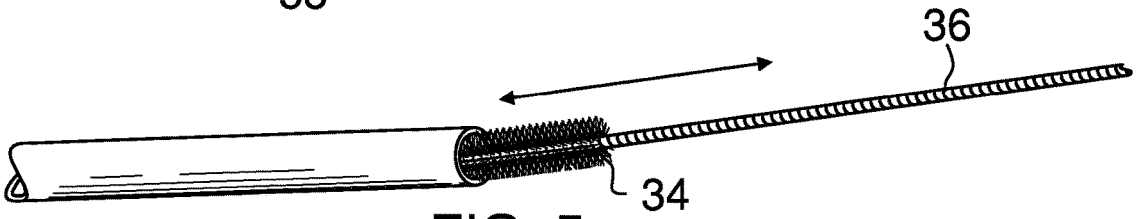
FIG. 5 is an in-use view of an embodiment of the disclosure.
Figure 12:
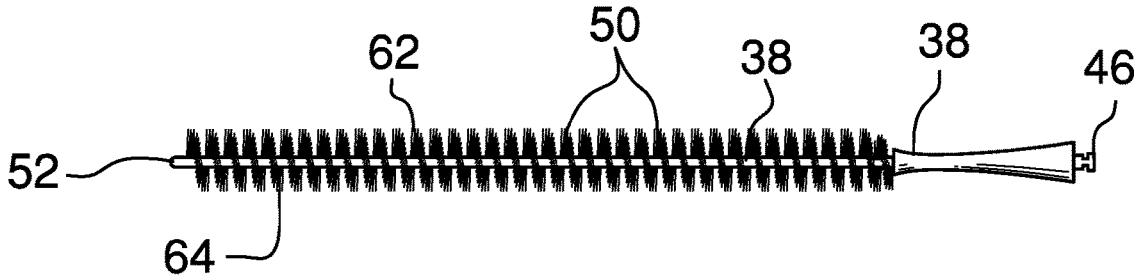
FIG. 12 is a side view of an embodiment of the disclosure.

The plurality of cleaning heads 32 comprises a plurality of brushes 34, as shown in FIGS. 4 and 12. Each brush 34 comprises a rod 36. The rod 36 comprises a coiled wire 38 so that the rod 36 is flexible. Each rod 36 has a respective length so that the plurality of brushes 34 comprises brushes 34 that have rods 36 of a variety of lengths.

A connector 38 is coupled to a first terminus 40 of the rod 36. The connector 38 comprises a cone 42 that has an apex 44. The apex 44 is coupled to the first terminus 40 of the rod 36. A tab 46 is coupled to and extends from a base 48 of the cone 42.

A plurality of scrubbing bristles 50 is coupled to and extends radially from the rod 36. The plurality of scrubbing bristles 50 extends from a second terminus 52 of the rod 36 toward the first terminus 40. The scrubbing bristles 50 are flexible. Each brush 34 comprises scrubbing bristles 50 that have a respective length so that the plurality of brushes 34 comprises brushes 34 that have scrubbing bristles 50 of a variety of lengths. Each brush 34 is configured to clean a tubular object that has an inner diameter that is complementary to the plurality of scrubbing bristles 50 of the brush.

The plurality of brushes 34 comprises a long-length bristled brush 54, a medium-length bristled brush 56, a short-length bristled brush 58, as shown in FIG. 4, a first spiral brush 60, as shown in FIG. 1, and a second spiral brush 62, as shown in FIG. 12. The first spiral brush 60 and the second spiral brush 62 have scrubbing bristles 50 that extend in a row 64. The row 64 extends spirally around the rod 36 from the second terminus 52 of the rod 36 toward the first terminus 40. The row 64 of the second spiral brush 62 extends to proximate to the connector 38.

The plurality of cleaning heads 32 also comprises a plurality of utensils 66. Each utensil 66 comprises a pole 68. Each pole 68 has a respective length so that the plurality of utensils 66 comprises utensils 66 that have poles 68 of a variety of lengths. A fastener 70 is coupled to a first endpoint 72 of the pole 68. The fastener 70 comprises a conoid 74 that has a vertex 76. The vertex 76 is coupled to the first endpoint 72 of the pole 68. An extrusion 78 is coupled to and extends from a foot 144 of the conoid 74.

Figure 6:
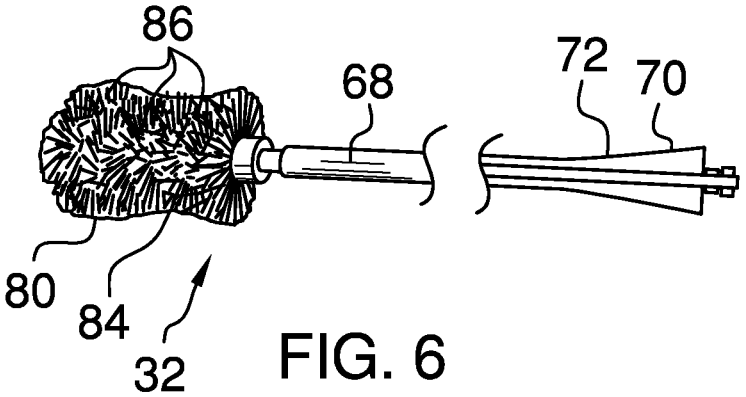
FIG. 6 is a side view of an embodiment of the disclosure.
Figure 7:
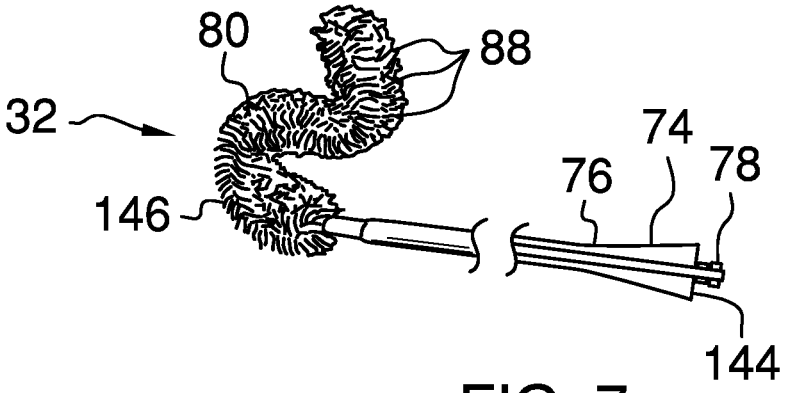
FIG. 7 is a side view of an embodiment of the disclosure.
Figure 8:
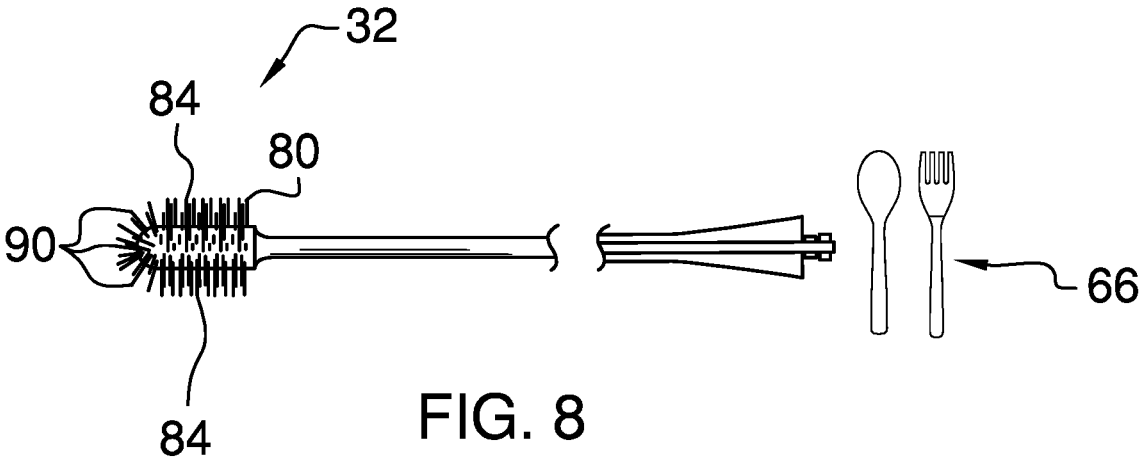
FIG. 8 is a side view of an embodiment of the disclosure.
Figure 9:
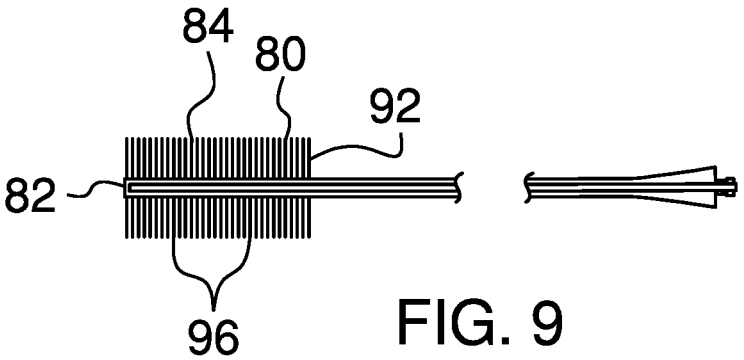
FIG. 9 is a side view of an embodiment of the disclosure.
Figure 10:
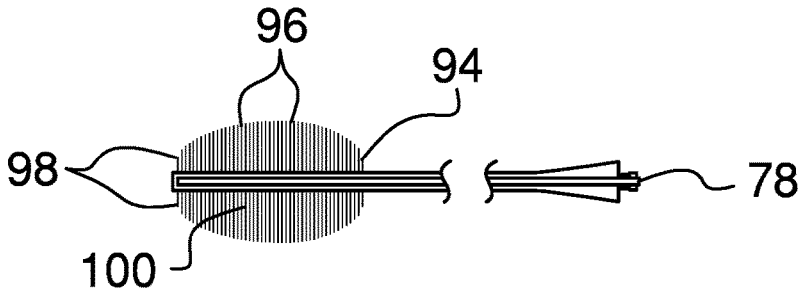
FIG. 10 is a side view of an embodiment of the disclosure.
Figure 11:
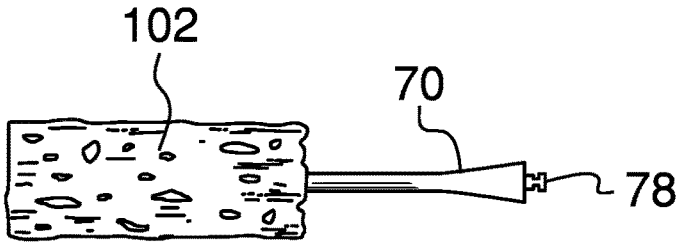
FIG. 11 is a side view of an embodiment of the disclosure.

A tool 80 is coupled proximate to a second endpoint 82 of the pole 68 so that the plurality of utensils 66 comprises a plurality of tools 84. Each tool 80 serves a respective cleaning function. The plurality of tools 84 comprises:

i. a plurality of blade bristles 86, as shown in FIG. 6. The blade bristles 86 are coupled to and extend radially from the pole 68. The plurality of blade bristles 86 extends from the second endpoint 82 toward the first endpoint 72 of the pole 68. The blade bristles 86 are configured to clean blades of a food processor, ii. a plurality of strips 88, as shown in FIG. 7. Each strip 88 is coupled to and extends from a cord 146 so that the plurality of strips 88 is tubularly shaped. The strips 88 comprise cloth so that the strips 88 are water-absorbent. The plurality of strips 88 is configured to dry the tubular object, iii. a plurality of first fibers 90, as shown in FIG. 8. Each first fiber 90 is coupled to and extends radially from the pole 68. The first fibers 90 are rigid so that the plurality of first fibers 90 is configured to scour a surface of an article, iv. a first straight brush 92 and a second straight brush 94, as shown in FIGS. 9 and 10, respectively. The first straight brush 92 and the second straight brush 94 each have a plurality of second fibers 96. Each second fiber 96 is coupled to and extends radially from the pole 68. The plurality of second fibers 96 is positioned in a pair of lines 98. The lines 98 are opposingly positioned on the pole 68. The first straight brush 92 and the second straight brush 94 are configured to insert into a hard to reach location to clean the hard to reach location. The second fibers 96 of the first straight brush 92 are of equivalent length. Each second fiber 96 of the second straight brush 94 has a respective length so that each line 98 of the plurality of second fibers 96 is arcuate when viewed from a side 100 of the second straight brush, and v. a sponge 102, as shown in FIG. 11. The sponge 102 is coupled to the pole 68 and extends toward the first endpoint 72 of the pole 68. The sponge 102 is substantially cylindrically shaped.

A coupler 104 is rotationally and sealably coupled to a second end 106 of the housing 12. The coupler 104 is operationally coupled to the motor 30. The coupler 104 is complementary to the connectors 38. The coupler 104 is positioned to selectively couple to a respective connector 38 to operationally couple an associated cleaning head 32 to the motor 30. The motor 30 positioned to rotate the respective cleaning head 32 to clean the article.

The coupler 104 also is complementary to the fasteners 70. The coupler 104 is positioned to selectively couple to a respective fastener 70 to operationally couple an associated cleaning head 32 to the motor 30. The motor 30 is positioned to rotate the respective cleaning head 32 to clean the article.

Figure 2:
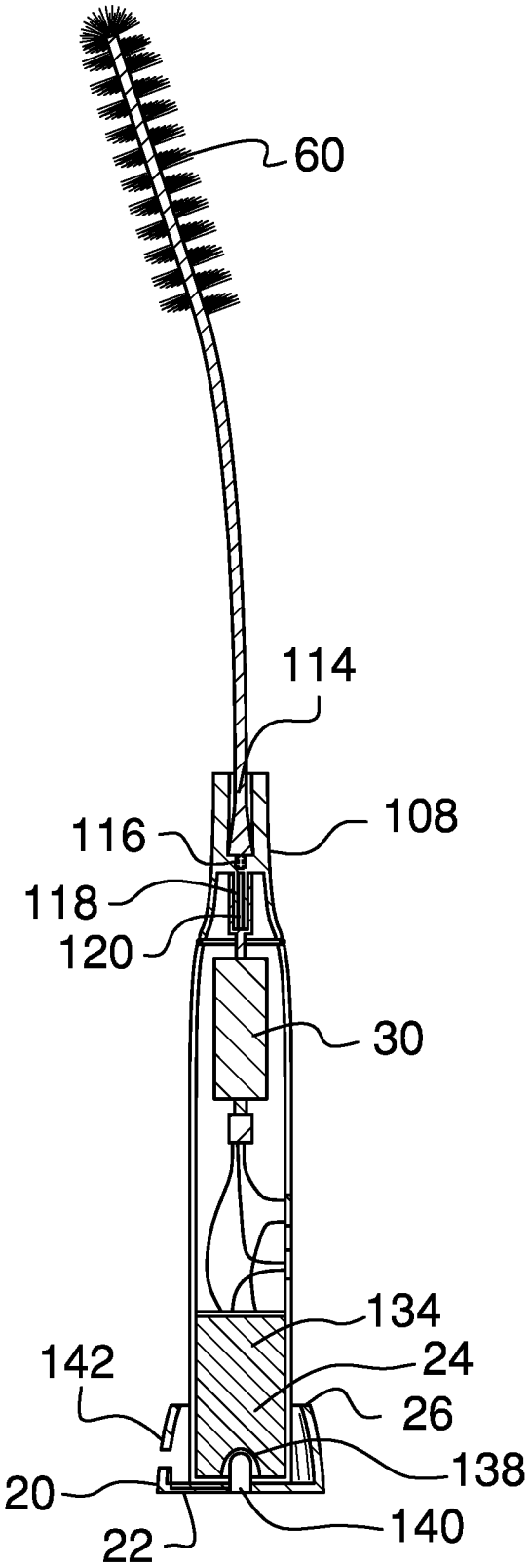
FIG. 2 is a cross-sectional view of an embodiment of the disclosure.
Figure 3:
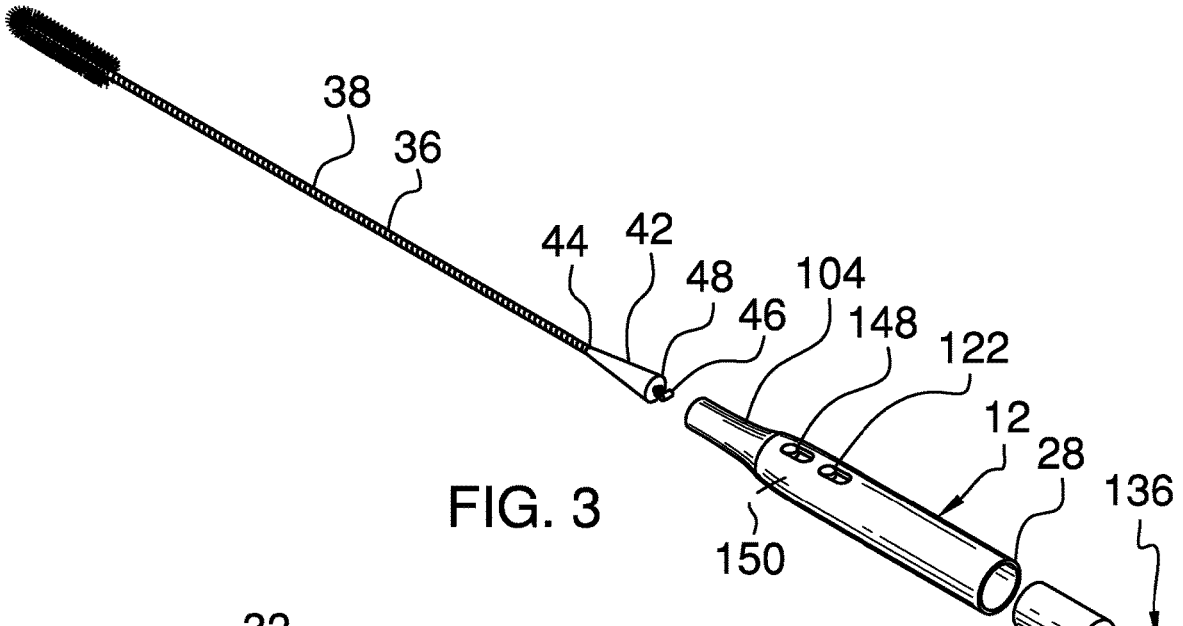
FIG. 3 is an isometric perspective view of an embodiment of the disclosure.

The coupler 104 comprises a bar 108 that is rotationally and sealably coupled to the second end 106 of the housing 12, as shown in FIG. 2. The bar 108 is substantially cylindrically shaped. The bar 108 has a first limit 110 proximate to the housing 12 and a second limit 112 distal from the housing 12. The bar 108 is tapered so that the second limit 112 is circumferentially smaller than the first limit 110.

A first channel 114 extends from the second limit 112 into the bar 108. The first channel 114 is complementary to the cones 42 and the conoids 74. The first channel 114 is positioned to selectively insert the cone 42 of a respective connector 38. The first channel 114 also is positioned to selectively insert the conoid 74 of a respective fastener 70.

An indentation 116 extends from the first channel 114 into the bar 108 toward the first limit 110 of the bar 108. The indentation 116 is complementary to the tab 46 and the extrusion 78. The indentation 116 is positioned to insert a respective tab 46 to couple an associated brush 34 to the bar 108. The indentation 116 also is positioned to insert a respective extrusion 78 to couple an associated utensil 66 to the bar 108.

A second channel 118 extends into the first limit 110 of the bar 108. The second channel 118 is complementary to a shaft 120 of the motor 30. The shaft 120 is positioned in the second channel 118 so that the motor 30 is positioned to rotate the bar 108 concurrent with the shaft 120.

A switch 122 is coupled to the housing 12, as shown in FIG. 1. The switch 122 is operationally coupled to the power module 16 and the motor 30. The switch 122 is positioned to selectively couple the motor 30 to the power module 16 to power the motor 30. The switch 122 is slide-type.

A selector 148 is coupled to the housing 12, as shown in FIG. 1. The selector 148 is operationally coupled to the power module 16 and the motor 30. The selector 148 is positioned to select a polarity of a voltage supplied by the power module 16 to the motor 30 to select a direction of rotation of the shaft 120.

Figure 13:
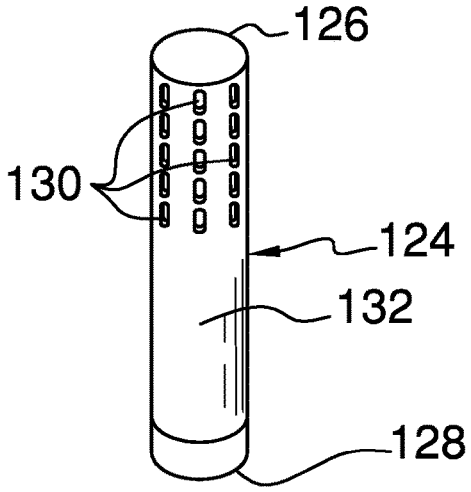
FIG. 13 is an isometric perspective view of an embodiment of the disclosure.

The assembly 10 comprises a plurality of covers 124, as shown in FIG. 13. The covers 124 are tubularly shaped. Each cover 124 has a top 126 and a bottom 128. The top 126 is closed. The bottom 128 is open so that the bottom 128 is positioned to insert a respective cleaning head 32 into the cover 124 to store the respective cleaning head 32. Each cover 124 has a plurality of slots 130 that is positioned in an annular wall 132 of the cover 124, proximate to the top 126 of the cover 124. The slots 130 are configured to vent the cover 124 to dry the respective cleaning head 32.

In another embodiment of the invention, as shown in FIG. 2, a cam and gear unit 150 is operationally coupled to the motor 30. The cam and gear unit 150 is positioned to convert rotary motion of the motor 30 into oscillatory motion so that a respective cleaning head 32 that is coupled to the housing 12 oscillates.

In yet another embodiment of the invention, as shown in FIG. 3. The first end 28 of the housing 12 is open. In this embodiment, the power module 16 comprises a battery 134 that is rechargeable. A cap 136 is selectively couplable to the housing 12 to close the first end 28. The cap 136 is configured to be decoupled from the housing 12 to replace the battery 134.

A first connector 138 is coupled to the cap 136. The first connector 138 is operationally coupled to the power module 16 when the cap 136 is coupled to the housing 12. A second connector 140 is coupled to the base unit 20. The second connector 140 is complementary to the first connector 138. The second connector 140 is positioned to couple to the first connector 138 as the first end 28 of the housing 12 is inserted into the recess 24. A third connector 142 is coupled to the base unit 20. The third connector 142 is operationally coupled to the second connector 140. The third connector 142 is configured to couple to a source of direct current so that direct current is supplied through the second connector 140 and the first connector 138 to the battery 134 to recharge the battery 134.

In use, a cleaning head 32 from the plurality of cleaning heads 32 is selected and coupled to the housing 12 so that the cleaning head 32 is operationally coupled to the motor 30. The motor 30 is positioned to rotate the cleaning head 32 to clean the article.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rotary cleaning tool assembly comprising:

a housing defining an interior space;

a power module coupled to said housing and positioned in said interior space;

a motor coupled to said housing and positioned in said interior space, said motor being operationally coupled to said power module;

a plurality of cleaning heads, each said cleaning head being selectively couplable to said housing such that said cleaning head is operationally coupled to said motor positioning said motor for rotating said cleaning head for cleaning an article; and a plurality of covers, said covers being tubularly shaped, each said cover having a top and a bottom, said top being closed, said bottom being open wherein said bottom is positioned for inserting a respective cleaning head into said cover for storing said respective said cleaning head, each said cover having a plurality of slots positioned in an annular wall of said cover proximate to said top of said cover wherein said slots are configured for venting said cover for drying said respective said cleaning head.

2. The assembly of claim 1, further including said housing being substantially cylindrically shaped.

3. The assembly of claim 1, further including said power module comprising a power cord.

4. The assembly of claim 1, further comprising:

a base unit having a lower face configured for resting on a horizontal surface; and a recess positioned in an upper face of said base unit, said recess being complementary to a first end of said housing wherein said recess is positioned for inserting said first end of said housing for supporting said housing substantially perpendicularly to the horizontal surface.

5. The assembly of claim 4, further comprising:

said first end of said housing being open;

said power module comprising a battery; and a cap, said cap being selectively couplable to said housing for closing said first end wherein said cap is configured for decoupling from said housing for replacing said battery.

6. The assembly of claim 1, further comprising:

said plurality of cleaning heads comprising a plurality of brushes, each said brush comprising:

a rod, said rod comprising a coiled wire such that said rod is flexible, each said rod having a respective length such that said plurality of brushes comprises brushes having rods of a variety of lengths, a rod connector coupled to a first terminus of said rod, and a plurality of scrubbing bristles coupled to and extending radially from said rod, said plurality of scrubbing bristles extending from a second terminus of said rod toward said first terminus, said scrubbing bristles being flexible, each said brush comprising scrubbing bristles having a respective unique length such that said plurality of brushes comprises brushes having scrubbing bristles of a variety of lengths wherein each said brush is configured for cleaning a tubular object having an inner diameter complementary to the unique length of said plurality of scrubbing bristles of said brush; and a coupler rotationally and sealably coupled to a second end of said housing, said coupler being operationally coupled to said motor, said coupler being complementary to said rod connectors wherein said coupler is positioned for selectively coupling to a respective rod connector for operationally coupling an associated said cleaning head to said motor positioning said motor for rotating said respective said cleaning head for cleaning the article.

7. The assembly of claim 6, further including said plurality of brushes comprising a long-length bristled brush, a medium-length bristled brush, a short-length bristled brush, a first spiral brush, and a second spiral brush, said first spiral brush and said second spiral brush having scrubbing bristles extending in a row extending spirally around said rod from said second terminus of said rod toward said first terminus, said row of said second spiral brush extending to proximate to said rod connector.

8. The assembly of claim 1, further comprising:

said plurality of cleaning heads comprising a plurality of utensils, each said utensil comprising:

a pole, each said pole having a respective length such that said plurality of utensils comprises utensils having poles of a variety of lengths, a fastener coupled to a first endpoint of said pole, and a tool coupled proximate to a second endpoint of said pole such that said plurality of utensils comprises a plurality of tools, each said tool serving a respective cleaning function; and a coupler rotationally and sealably coupled to a second end of said housing, said coupler being operationally coupled to said motor, said coupler being complementary to said fasteners wherein said coupler is positioned for selectively coupling to a respective fastener for operationally coupling an associated said cleaning head to said motor positioning said motor for rotating said respective said cleaning head for cleaning the article.

9. The assembly of claim 1, further including a switch coupled to said housing, said switch being operationally coupled to said power module and said motor wherein said switch is positioned for selectively coupling said motor to said power module for powering said motor, said switch being slide-type.

10. The assembly of claim 1, further including a selector coupled to said housing, said selector being operationally coupled to said power module and said motor wherein said selector is positioned for selecting a polarity of a voltage supplied from said power module to said motor for selecting a direction of rotation of said shaft.

11. The assembly of claim 1, further including a cam and gear unit operationally coupled to said motor wherein said cam and gear unit is positioned for converting rotary motion of said motor into oscillatory motion such that a respective said cleaning head coupled to said housing oscillates.

12. A rotary cleaning tool assembly comprising:

a housing defining an interior space;

a power module coupled to said housing and positioned in said interior space;

a motor coupled to said housing and positioned in said interior space, said motor being operationally coupled to said power module;

a plurality of cleaning heads, each said cleaning head being selectively couplable to said housing such that said cleaning head is operationally coupled to said motor positioning said motor for rotating said cleaning head for cleaning an article;

said plurality of cleaning heads comprising a plurality of brushes, each said brush comprising:

a rod, said rod comprising a coiled wire such that said rod is flexible, each said rod having a respective length such that said plurality of brushes comprises brushes having rods of a variety of lengths, a rod connector coupled to a first terminus of said rod, and a plurality of scrubbing bristles coupled to and extending radially from said rod, said plurality of scrubbing bristles extending from a second terminus of said rod toward said first terminus, said scrubbing bristles being flexible, each said brush comprising scrubbing bristles having a respective unique length such that said plurality of brushes comprises brushes having scrubbing bristles of a variety of lengths wherein each said brush is configured for cleaning a tubular object having an inner diameter complementary to the unique length of said plurality of scrubbing bristles of said brush;

a coupler rotationally and sealably coupled to a second end of said housing, said coupler being operationally coupled to said motor, said coupler being complementary to said rod connectors wherein said coupler is positioned for selectively coupling to a respective rod connector for operationally coupling an associated said cleaning head to said motor positioning said motor for rotating said respective said cleaning head for cleaning the article;

said connector comprising:

a cone having an apex coupled to said first terminus of said rod, and a tab coupled to and extending from a base of said cone; and said coupler comprising:

a bar rotationally and sealably coupled to said second end of said housing, said bar being substantially cylindrically shaped, said bar having a first limit proximate to said housing and a second limit distal from said housing, said bar being tapered such that said second limit is circumferentially smaller than said first limit, a first channel extending from said second limit into said bar, said first channel being complementary to said tab wherein said first channel is positioned for selectively inserting said tab of a respective said connector, an indentation extending from said first channel into said bar toward said first limit of said bar, said indentation being complementary to said tab wherein said indentation is positioned for inserting a respective said tab for coupling an associated said brush to said bar, and a second channel extending into said first limit of said bar, said second channel being complementary to a shaft of said motor, said shaft being positioned in said second channel wherein said motor is positioned for rotating said bar concurrent with said shaft.

13. A rotary cleaning tool assembly comprising:

a housing defining an interior space;

a power module coupled to said housing and positioned in said interior space;

a motor coupled to said housing and positioned in said interior space, said motor being operationally coupled to said power module;

a plurality of cleaning heads, each said cleaning head being selectively couplable to said housing such that said cleaning head is operationally coupled to said motor positioning said motor for rotating said cleaning head for cleaning an article;

said plurality of cleaning heads comprising a plurality of utensils, each said utensil comprising:

a pole, each said pole having a respective length such that said plurality of utensils comprises utensils having poles of a variety of lengths, a fastener coupled to a first endpoint of said pole, and a tool coupled proximate to a second endpoint of said pole such that said plurality of utensils comprises a plurality of tools, each said tool serving a respective cleaning function;

a coupler rotationally and sealably coupled to a second end of said housing, said coupler being operationally coupled to said motor, said coupler being complementary to said fasteners wherein said coupler is positioned for selectively coupling to a respective fastener for operationally coupling an associated said cleaning head to said motor positioning said motor for rotating said respective said cleaning head for cleaning the article;

said fastener comprising:

a conoid having a vertex coupled to said first endpoint of said pole, and an extrusion coupled to and extending from a foot of said conoid; and said coupler comprising:

a bar rotationally and sealably coupled to said second end of said housing, said bar being substantially cylindrically shaped, said bar having a first limit proximate to said housing and a second limit distal from said housing, said bar being tapered such that said second limit is circumferentially smaller than said first limit, a first channel extending from said second limit into said bar, said first channel being complementary to said extrusion wherein said first channel is positioned for selectively inserting said extrusion of a respective said fastener, an indentation extending from said first channel into said bar toward said first limit of said bar, said indentation being complementary to said extrusion wherein said indentation is positioned for inserting a respective said extrusion for coupling an associated said utensil to said bar, and a second channel extending into said first limit of said bar, said second channel being complementary to a shaft of said motor, said shaft being positioned in said second channel wherein said motor is positioned for rotating said bar concurrent with said shaft.

14. A rotary cleaning tool assembly comprising:

a housing defining an interior space;

a power module coupled to said housing and positioned in said interior space;

a motor coupled to said housing and positioned in said interior space, said motor being operationally coupled to said power module;

a plurality of cleaning heads, each said cleaning head being selectively couplable to said housing such that said cleaning head is operationally coupled to said motor positioning said motor for rotating said cleaning head for cleaning an article;

a base unit having a lower face configured for resting on a horizontal surface;

a recess positioned in an upper face of said base unit, said recess being complementary to a first end of said housing wherein said recess is positioned for inserting said first end of said housing for supporting said housing substantially perpendicularly to the horizontal surface;

said first end of said housing being open;

said power module comprising a battery;

a cap, said cap being selectively couplable to said housing for closing said first end wherein said cap is configured for decoupling from said housing for replacing said battery;

said battery being rechargeable;

a first connector coupled to said cap, said first connector being operationally coupled to said power module when said cap is coupled to said housing;

a second connector coupled to said base unit, said second connector being complementary to said first connector wherein said second connector is positioned for coupling to said first connector as said first end of said housing is inserted into said recess; and a third connector coupled to said base unit, said third connector being operationally coupled to said second connector, said third connector being configured for coupling to a source of direct current wherein direct current is supplied through said second connector and said first connector to said battery for recharging said battery.

15. A rotary cleaning tool assembly comprising:

a housing defining an interior space, said housing being substantially cylindrically shaped;

a power module coupled to said housing and positioned in said interior space, said power module comprising a power cord;

a base unit having a lower face configured for resting on a horizontal surface; and a recess positioned in an upper face of said base unit, said recess being complementary to a first end of said housing wherein said recess is positioned for inserting said first end of said housing for supporting said housing substantially perpendicularly to the horizontal surface;

a motor coupled to said housing and positioned in said interior space, said motor being operationally coupled to said power module;

a plurality of cleaning heads, each said cleaning head being selectively couplable to said housing such that said cleaning head is operationally coupled to said motor positioning said motor for rotating said cleaning head for cleaning an article, said plurality of cleaning heads comprising a plurality of brushes, each said brush comprising:

a rod, said rod comprising a coiled wire such that said rod is flexible, each said rod having a respective length such that said plurality of brushes comprises brushes having rods of a variety of lengths, a rod connector coupled to a first terminus of said rod, said rod connector comprising:

a cone having an apex coupled to said first terminus of said rod, and a tab coupled to and extending from a base of said cone; and a plurality of scrubbing bristles coupled to and extending radially from said rod, said plurality of scrubbing bristles extending from a second terminus of said rod toward said first terminus, said scrubbing bristles being flexible, each said brush comprising scrubbing bristles having a unique respective length such that said plurality of brushes comprises brushes having scrubbing bristles of a variety of lengths wherein each said brush is configured for cleaning a tubular object having an inner diameter complementary to the unique respective length of said plurality of scrubbing bristles of said brush, said plurality of brushes comprising a long-length bristled brush, a medium-length bristled brush, a short-length bristled brush, a first spiral brush, and a second spiral brush, said first spiral brush and said second spiral brush having scrubbing bristles extending in a row extending spirally around said rod from said second terminus of said rod toward said first terminus, said row of said second spiral brush extending to proximate to said connector;

said plurality of cleaning heads comprising a plurality of utensils, each said utensil comprising:

a pole, each said pole having a respective length such that said plurality of utensils comprises utensils having poles of a variety of lengths, a fastener coupled to a first endpoint of said pole, said fastener comprising:

a conoid having a vertex coupled to said first endpoint of said pole, and an extrusion coupled to and extending from a foot of said conoid, and a tool coupled proximate to a second endpoint of said pole such that said plurality of utensils comprises a plurality of tools, each said tool serving a respective cleaning function;

a coupler rotationally and sealably coupled to a second end of said housing, said coupler being operationally coupled to said motor, said coupler being complementary to said connectors wherein said coupler is positioned for selectively coupling to a respective rod connector for operationally coupling an associated said cleaning head to said motor positioning said motor for rotating said respective said cleaning head for cleaning the article, said coupler being complementary to said fasteners wherein said coupler is positioned for selectively coupling to a respective fastener for operationally coupling an associated said cleaning head to said motor positioning said motor for rotating said respective said cleaning head for cleaning the article, said coupler comprising:

a bar rotationally and sealably coupled to said second end of said housing, said bar being substantially cylindrically shaped, said bar having a first limit proximate to said housing and a second limit distal from said housing, said bar being tapered such that said second limit is circumferentially smaller than said first limit, a first channel extending from said second limit into said bar, said first channel being complementary to said tabs and said extrusions wherein said first channel is positioned for selectively inserting said tab of a respective said connector, wherein said first channel is positioned for selectively inserting said extrusion of a respective fastener, an indentation extending from said first channel into said bar toward said first limit of said bar, said indentation being complementary to said tab and said extrusion wherein said indentation is positioned for inserting a respective said tab for coupling an associated said brush to said bar, wherein said indentation is positioned for inserting a respective said extrusion for coupling an associated said utensil to said bar, and a second channel extending into said first limit of said bar, said second channel being complementary to a shaft of said motor, said shaft being positioned in said second channel wherein said motor is positioned for rotating said bar concurrent with said shaft;

a switch coupled to said housing, said switch being operationally coupled to said power module and said motor wherein said switch is positioned for selectively coupling said motor to said power module for powering said motor, said switch being slide-type;

a selector coupled to said housing, said selector being operationally coupled to said power module and said motor wherein said selector is positioned for selecting a polarity of a voltage supplied from said power module to said motor for selecting a direction of rotation of said shaft; and a plurality of covers, said covers being tubularly shaped, each said cover having a top and a bottom, said top being closed, said bottom being open wherein said bottom is positioned for inserting a respective cleaning head into said cover for storing said respective said cleaning head, each said cover having a plurality of slots positioned in an annular wall of said cover proximate to said top of said cover wherein said slots are configured for venting said cover for drying said respective said cleaning head.

16. The assembly of claim 15, further including a cam and gear unit operationally coupled to said motor wherein said cam and gear unit is positioned for converting rotary motion of said motor into oscillatory motion such that a respective said cleaning head coupled to said housing oscillates.

17. The assembly of claim 15, further comprising:

said first end of said housing being open;

said power module comprising a battery, said battery being rechargeable;

a cap, said cap being selectively couplable to said housing for closing said first end wherein said cap is configured for decoupling from said housing for replacing said battery;

a first connector coupled to said cap, said first connector being operationally coupled to said power module when said cap is coupled to said housing;

a second connector coupled to said base unit, said second connector being complementary to said first connector wherein said second connector is positioned for coupling to said first connector as said first end of said housing is inserted into said recess; and a third connector coupled to said base unit, said third connector being operationally coupled to said second connector, said third connector being configured for coupling to a source of direct current wherein direct current is supplied through said second connector and said first connector to said battery for recharging said battery.

* * * * *